United States Patent [19]

Langer et al.

[11] Patent Number: 4,589,495

[45] Date of Patent: May 20, 1986

[54] APPARATUS AND METHOD FOR INSERTING FLOW CONTROL MEANS INTO A WELL CASING

[75] Inventors: Friedrich H. Langer; William D. Stringfellow, both of Houston, Tex.

[73] Assignee: Weatherford U.S., Inc., Houston, Tex.

[21] Appl. No.: 601,938

[22] Filed: Apr. 19, 1984

[51] Int. Cl.[4] ..... E21B 23/02; E21B 33/16; E21B 34/06

[52] U.S. Cl. ..... 166/383; 166/155; 166/156; 166/317; 166/325; 166/327; 166/386

[58] Field of Search ..... 166/325, 326, 327, 328, 166/242, 317, 386, 383, 153–156

[56] References Cited

U.S. PATENT DOCUMENTS

| | | | |
|---|---|---|---|
| 1,485,512 | 3/1924 | Le Coeq et al. . | |
| 1,685,307 | 9/1928 | Baker . | |
| 1,776,613 | 9/1930 | Baker . | |
| 1,994,846 | 3/1935 | Baker . | |
| 2,724,443 | 11/1955 | Baker . | |
| 2,751,021 | 6/1956 | Muse . | |
| 2,777,523 | 1/1957 | Brown et al. | 166/325 |
| 2,791,279 | 5/1957 | Clark, Jr. . | |
| 2,839,144 | 6/1958 | Ault | 166/325 X |
| 2,854,081 | 9/1958 | Kriegel | 166/188 |
| 2,913,052 | 11/1959 | Harmon | 166/144 |
| 3,105,378 | 10/1963 | Darling | 166/325 X |
| 3,106,932 | 10/1963 | Chisholm | 166/325 X |
| 3,129,764 | 4/1964 | Stein . | |
| 3,159,219 | 12/1964 | Scott | 166/328 X |
| 3,289,769 | 12/1966 | Nelson et al. . | |
| 3,332,499 | 7/1967 | Harris et al. | 166/242 |
| 3,385,372 | 5/1968 | Knox . | |
| 3,545,543 | 12/1970 | Kammerer, Jr. et al. | 166/212 |
| 4,413,682 | 11/1983 | Callihan et al. | 166/382 |
| 4,478,279 | 10/1984 | Puntar et al. | 166/325 X |

OTHER PUBLICATIONS

Brantly, J. E., "History of Oil Well Drilling", Gulf Publishing Co., pp. 1273–1279, (1971).

Suman, G. O., et al., "Cementing Oil and Gas Wells", *World Oil*, (Jul. 1977), pp. 41–49.

*Composite Catalog of Oil Field Equipment and Services*, 1982–83, 35th Revision, vol. 3, published by *World Oil*, Gulf Publishing Co., Houston, Texas, pp. 3850–3857.

*Primary Examiner*—Stephen J. Novosad

*Attorney, Agent, or Firm*—Vinson & Elkins

[57] ABSTRACT

An apparatus and method for inserting flow control means into a well casing is disclosed. A receptacle having portions adapted to receive check valve means is mounted within said well casing and said well casing is inserted into a well. Check valve means may be pumped down into engagement with said receptacle to regulate the flow of fluid through the well casing. Alternatively, choke valve means may be pumped down into engagement with said receptacle instead of check valve means. The choke valve means may be constructed having portions adapted to receive check valve means so that check valve means may be pumped down into engagement with said choke valve means to regulate the flow of fluid through the well casing.

18 Claims, 17 Drawing Figures

APPARATUS AND METHOD FOR INSERTING FLOW CONTROL MEANS INTO A WELL CASING

This invention relates to equipment used to cement well casing into the wellbore of oil and gas wells and, more particularly, to the insertion and removal of flow control means in the well casing during cementing operations.

BACKGROUND OF THE INVENTION

In the oil and gas producing industry the process of cementing casing into the wellbore of an oil or gas well generally comprises several steps. A string of casing is run in a wellbore to the required depth. Then the well is conditioned by pumping a circulating fluid down through the casing and through the open lower end of the casing and then upwardly through the annular space between the external surface of the casing and the wellbore. This is done to clean the annular space and prepare it to receive the cement. Then a sufficient amount of cement slurry is pumped into the casing to fill the annulus between the casing and the wellbore wall to the desired height. Then a displacement medium, usually a drilling fluid, is pumped into the casing. The cement slurry is normally separated from the circulation fluid and the displacement fluid by rubber plugs. Due to the difference in specific gravity between the circulating fluid and the cement slurry, at first the heavier cement slurry drops inside the casing without having to be pumped by hydrostatic pressure exerted on the displacement fluid. After the height of cement slurry column outside the casing equals the height of the cement slurry column inside the casing, hydrostatic pressure must be exerted on the displacement fluid to force the rest of cement slurry out of the casing into the annulus.

After the desired amount of cement slurry has been pumped into the annulus, it is absolutely necessary to prevent the back flow of cement slurry into the casing until the cement slurry sets and hardens. This back flow is created by the difference in specific gravity of the heavier cement and the generally lighter displacement fluid. One method for preventing the back flow of cement slurry into the casing involves holding constant the hydrostatic pressure on the displacement fluid in the casing until the cement slurry sets and hardens. This method, however, expands the casing and creates nonadherence of the casing to the hardened cement after the hydrostatic pressure in the casing is released and the casing string contracts. Therefore, the preferred method involves placing a check valve in the lower end of the casing string to prevent the back flow of the cement slurry into the casing.

It is sometimes desirable to run the casing with the lower end of the casing fully open to the fluids in the wellbore. This mode of lowering the casing into the wellbore prevents the well fluids from resisting the descent of the casing. The well fluids exert a resistive hydrostatic pressure on the casing when the end of the casing is closed. It is sometimes desirable, however, to completely or partially close the opening in the lower end of the casing so that the well fluids resist the downward movement of the casing. When this is done the resistive forces due to the well fluids acting on the closed end of the casing offset a portion of the weight of the casing string. The resistive forces of the well fluids thereby relieve the derrick of a portion of the load that it bears in supporting the weight of the casing string.

Closing the opening in the lower end of the casing also prevents entry into the casing of larger particles suspended in the drilling mud in the bore hole. The presence of larger particles in the casing sometimes causes the opening to be plugged when pumping is commenced.

The presently existing methods for closing or restricting the lower end of the casing string involve the use of devices known as float shoes or float collars. These devices generally comprise tubular members threaded into and made a part of the casing string. If the device is located on the end of the casing string it is generally referred to as a float shoe. If the device is located between two joints of casing it is generally referred to as a float collar.

Both the float shoe and the float collar possess a passageway through the body of the device through which fluid may pass. The passage is equipped with a unidirectional valve which restricts the flow of fluid into the casing from the wellbore but permits the free flow of fluid from the casing into the wellbore. This valve is generally referred to as a check valve. Well known types of check valves include the ball type, the spring-loaded ball type, the plunger type, the flapper type and the multi-flapper type.

Currently existing techniques that involve the use of check valves in float shoes or float collars have certain disadvantages. The check valve in the float shoe or float collar is frequently damaged during the pumping of the circulating fluid through the check valve into the wellbore. Damage to the check valve may prevent the check valve from functioning properly and thereby allow well fluids to enter the casing. If the check valve is damaged it may not function properly during the cementing process. If a damaged check valve permits the leakage of cement back into the well casing, it will become necessary to maintain pressure on the well for an extended period of time during the cementing operation in order to "hold" the cement slurry in place while it sets and hardens. This problem could be avoided if the check valve were not in position within the well casing until after the pumping of the circulation fluid had been completed.

During the pumping of the circulating fluid it is beneficial to have the largest possible bore through the float shoe or float collar in order to have the smallest possible pressure drop across the passage through the float shoe or float collar. Accordingly, it is desirable to run the casing string with no check valve in the casing and then after the casing string has reached the required depth insert the check valve into place within the casing before beginning the cementing process.

If the check valve can be inserted after the casing has been lowered into position within the wellbore, it is possible to choose and utilize a specific type of check valve in response to information concerning the specific well conditions that exist at the desired depth.

During the stage of the cementing operation in which the cement slurry flows out of the casing into the annulus between the casing and the wellbore wall, the speed with which the column of cement slurry drops due to the difference in specific gravity between the cement slurry and the displacement fluid is undesirable. It would be preferable if the flow of cement slurry out of the casing were even, smooth and controlled. This would minimize the chance that the cement slurry would be unevenly distributed throughout the annulus. Thus there is a need for flow control means to control the flow of the cement slurry out of the casing and into the annulus and to prevent the backflow of the cement slurry into the casing after all of the cement slurry has been displaced into the annulus.

SUMMARY OF THE INVENTION

The present invention provides an improved method and apparatus for inserting and removing flow control means in a well casing. In its simplest form the invention comprises two interlocking assemblies of elements. The first assembly contains a check valve and is referred to as a check valve means. The second assembly comprises a receptacle mounted within the casing and is referred to as a receptacle means. The receptacle means is adapted to receive and retain the check valve means when the check valve means is pumped down through the casing into engagement with the receptacle means.

The check valve means generally comprises a cylindrically shaped check valve housing, a check valve, guide means, latching means and fluid sealing means. The cylindrically shaped check valve housing is formed with an axial passageway through which fluid may flow. A check valve in said passageway unidirectionally regulates the flow of fluid in the usual manner. The check valve housing may be fitted with guide means to appropriately position the check valve housing within the interior of the casing. Latching means are provided in the check valve housing for latching the check valve means into the receptacle means after the check valve means has engaged the receptacle means. A seal such as an O-ring in the check valve housing provides means for preventing the leakage of fluid through the interface between the check valve means and the receptacle means.

The receptacle means generally comprises a receptacle housing and a receptacle mounted therein. The receptacle housing may take the form of a cylindrical shell having the same inner and outer diameter as the casing and having threaded end portions for threaded engagement with the casing string. The receptacle mounted within the receptacle housing takes the form of a block of frangible material filling the interior of the receptacle housing and having portions defining an axial passageway therethrough. The top portion of the axial passageway is formed having a shape that is complementary to the shape of the external surface of the check valve means. When the check valve means descends through the casing it falls into and engages the receptacle means.

Means are also provided for inserting and removing flow control means for regulating the flow of the cement slurry from the casing into the annulus.

In an alternate embodiment of the invention, the receptacle means generally comprises a receptacle housing with a receptacle mounted therein constructed so that it will receive a check valve means and a choke valve means during the times of operation when those two different valve means are necessary in the cementing operation. The choke valve means is adapted to receive a second check valve means after the cement slurry has been displaced from the casing in order to prevent the backflow of the cement slurry into the casing. The receptacle, the choke valve means and the check valve means are all constructed of frangible material so that they may be drilled through and broken up by the drill bit after the cement slurry has set and hardened.

An object of the invention is to provide an apparatus and method for inserting and removing flow control means in a well casing in a well.

Another object of the invention is to provide an apparatus and method for running a casing string with no check valve in order to facilitate the running of the casing string and then inserting a check valve into the casing string at the desired depth before beginning cementing operations.

Another object of the invention is to provide an apparatus and method for inserting a specific type of check valve into a well casing in a well in response to information concerning the specific well conditions that exist at the desired depth.

Still another object of the invention is to provide an apparatus and method for regulating the flow of cement slurry from the casing into the annulus and for preventing the back flow of cement slurry into the casing.

Yet another object of the invention is to provide an apparatus and method for conducting cementing operations using check valve means to prevent the entry of well fluid into the casing while the casing is being run and then removing said check valve means to facilitate the passage of circulating fluid through the casing and then using choke valve means to regulate the flow of cement slurry from the casing into the annulus and then using check valve means to prevent the back flow of cement slurry into the casing.

Other objects and advantages of the invention will become apparent from a consideration of the detailed description and the drawings.

DESCRIPTION OF THE PREFERRED EMBODIMENT

Figure 1:
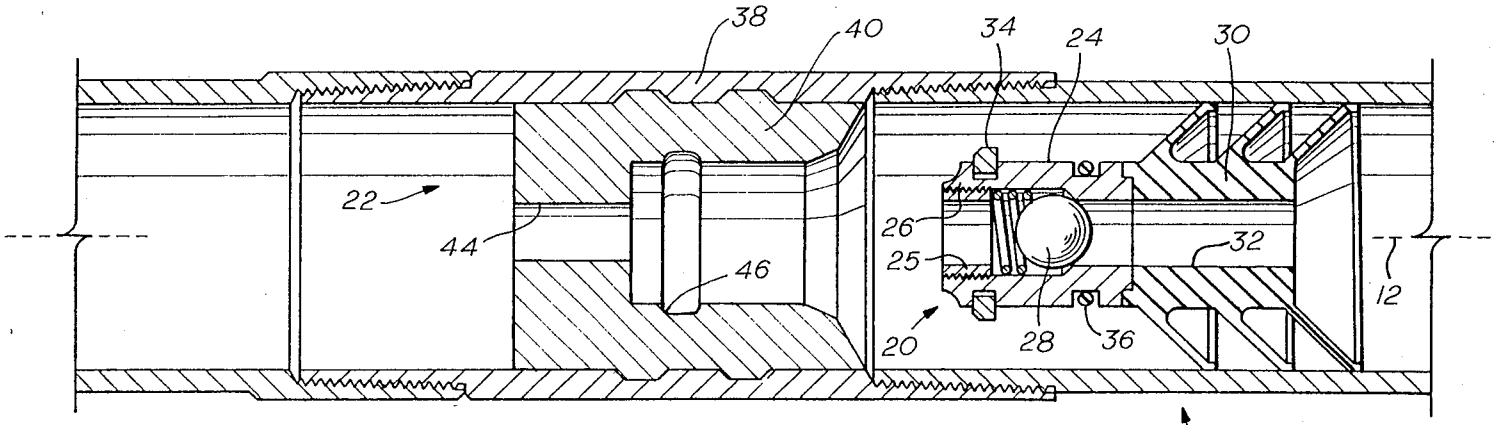
FIG. 1 is a sectional side view of the apparatus showing the receptacle means mounted within the well casing and the check valve means for engaging the receptacle means.

The apparatus of the invention is schematically depicted in FIG. 1. The well casing is generally denoted by the numeral 10. The axis of well casing 10 is denoted by the numeral 12. The check valve means is generally denoted by the numeral 20 and the receptacle means is generally denoted by the numeral 22.

In the preferred embodiment of the invention check valve means 20 comprises a cylindrically symmetrical check valve housing 24 having its axis of cylindrical symmetry parallel to and aligned with the axis 12 of the well casing 10. Check valve housing 24 is formed having a passageway 26 that passes through the center of check valve housing 24 along the axis of cylindrical symmetry of check valve housing 24. In the preferred embodiment of the invention a check valve 28 is releasably secured within passageway 26 of check valve housing 24 with a threaded retaining ring 25 adapted to engage a threaded portion of check valve housing 24. Of course, it is also possible to permanently secure check valve 28 within check valve housing 24. Check valve 28 unidirectionally regulates the flow of fluid through passageway 26 in a manner well known in the prior art. As shown in FIG. 1, cylindrically shaped guide means 30 are attached to check valve housing 24 to center and align check valve housing 24 along the axis 12 of well casing 10. Guide means 30 is formed having a passageway 32 through the center of guide means 30. Passageway 26 and passageway 32 form a single passageway through check valve means 20 when guide means 30 is attached to check valve housing 24.

Latching means such as spring loaded latches 34 are provided in recesses cut into the exterior surface of check valve housing 24 for latching the check valve means 20 into the receptacle means 22 after the check valve means 20 has engaged the receptacle means 22. An O-ring 36 in a groove cut into the exterior surface of check valve housing 24 prevents the leakage of fluid through the interface between the exterior surface of check valve housing 24 and the adjacent receptacle means 22 after the check valve assembly has engaged the receptacle means 22.

The receptacle means 22 generally comprises a receptacle housing 38 and a receptacle 40 mounted therein. As shown in FIG. 1, the receptacle housing 38 is a cylindrically shaped steel shell having approximately the same inner and outer diameters as the well casing 10 and having threaded end portions for threaded engagement with the joints of the well casing 10. The receptacle 40 is mounted within receptacle housing 38. Receptacle 40 is constructed of frangible material such as cement, aluminum or similar material. Receptacle 40 is formed having portions defining an axial passageway 44 preferably through the center of receptacle 40 along the axis of well casing 10. Of course, in an alternate embodiment of the invention axial passageway 44 may be formed through receptacle 40 not along the central axis of receptacle 40.

As shown in FIG. 1, the top portion of axial passageway 44 is formed having a shape that is complementary to the shape of the external surface of the check valve means 20. Check valve housing 24 of check valve means 20 fits snugly within the top portion of axial passageway 44. Latching means 34 engage a groove 46 in receptacle 40 to lock the check valve means 20 into engagement with receptacle 40. After check valve means 20 is engaged within receptacle means 22, the check valve 28 regulates the flow of fluid through passageway 26.

Figure 2:
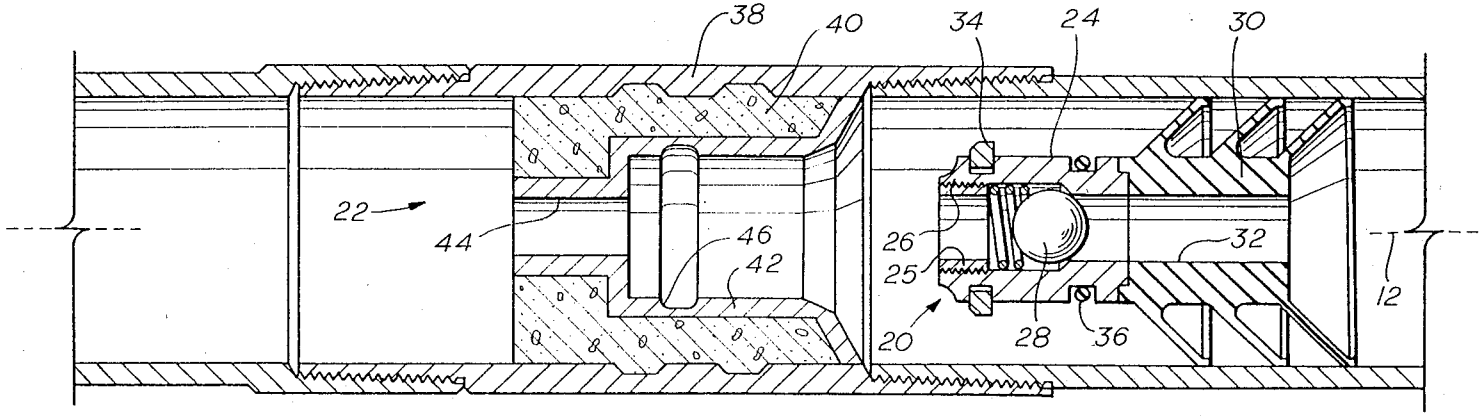
FIG. 2 is a sectional side view of an alternate embodiment of the apparatus showing a metal sleeve for lining the axial passageway of the receptacle means.

As shown in FIG. 2, receptacle 40 may be provided with a sleeve 42 of metal or other material for lining the axial passageway 44. The use of a sleeve 42 within axial passageway 44 may be desirable in those cases in which the receptacle 40 is made of cement or a similar material. The sleeve 42 prevents erosion of the walls of the receptacle 40 and insures that the check valve housing 24 fits into the sleeve 42 of receptacle 40 with a very close tolerance. The sleeve 42 shown in FIG. 2 may also be incorporated into the other embodiments of the invention shown in the remaining drawings.

Figure 3:
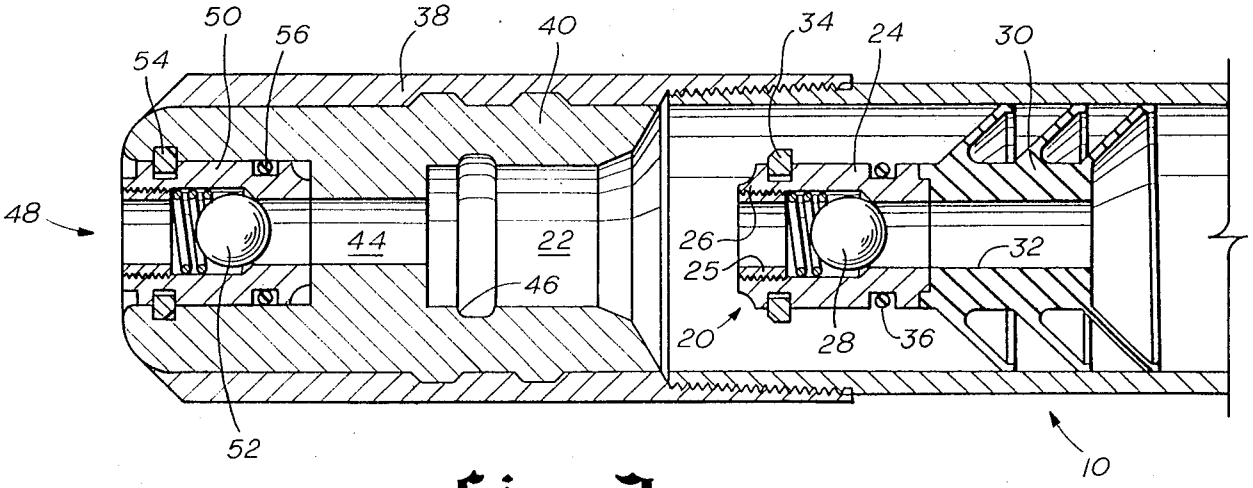
FIG. 3 is a sectional side view of the apparatus showing the use of the check valve means and the receptacle means in a float shoe.

FIG. 1 and FIG. 2 depict the use of the invention in a float collar. FIG. 3 depicts the use of the invention in a float shoe. The apparatus and method of operation of the invention are the same as that previously described except that the receptacle 40 and axial passageway 44 are extended to form the bottom of the float shoe. As depicted in FIG. 3, it is possible to place a second check valve means 48 in the bottom of the float shoe. The second check valve means 48 is of the same construction as that of check valve means 20. Specifically, second check valve means 48 comprises a check valve housing 50, a check valve 52, latching means 54 and an O-ring 56. The use of second check valve means 48 in the float shoe configuration of receptacle 40 is optional.

Figure 4:
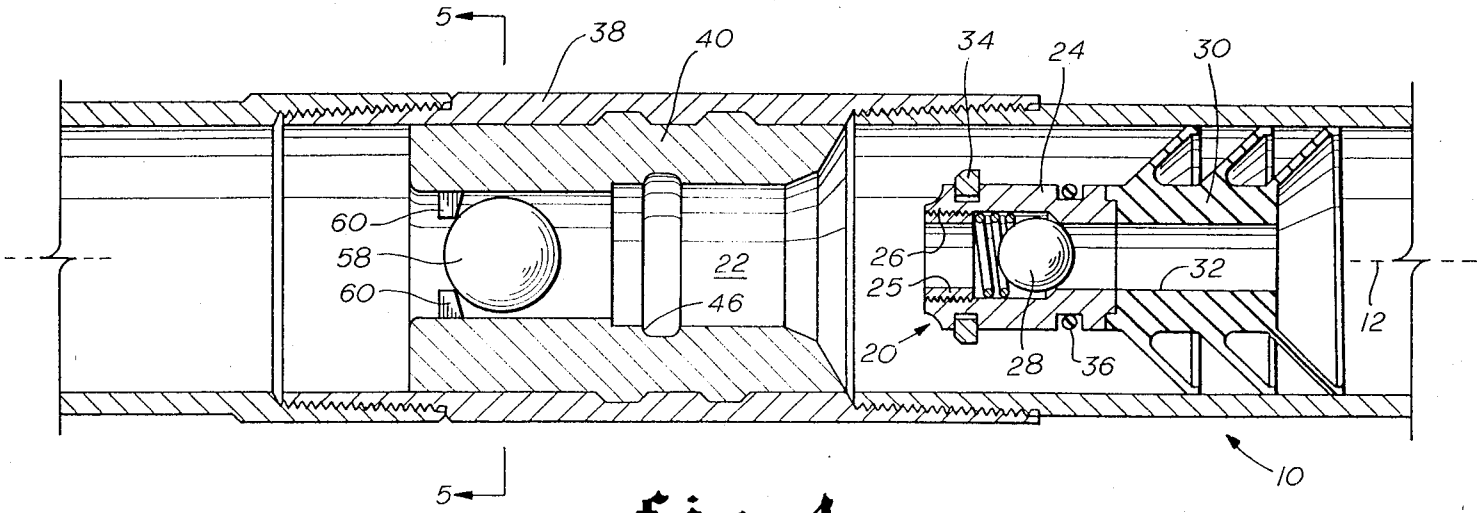
FIG. 4 is a sectional side view showing the use of a choke plug in conjunction with the check valve means and the receptacle means of the apparatus.
Figure 5:
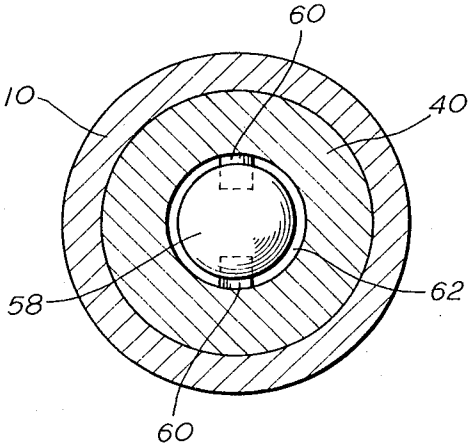
FIG. 5 is a cross-sectional view taken along line 5—5 of FIG. 4 showing the placement of the choke plug within the axial passageway of the receptacle means.

The apparatus and method of the invention may be used in conjunction with choke means for controlling fluid flow such as the choke plug 58 depicted in FIG. 4 and FIG. 5. In the preferred embodiment of the invention, a plurality of plug stops 60 are mounted within receptacle 40. As shown in the drawings, the plug stops 60 extend from receptacle 40 into the axial passageway 44. When it is desired to restrict the flow of the fluid through axial passageway 44 the choke plug 58 is pumped down through the well casing and it lodges against the plug stops 60 in axial passageway 44. At this point in time the check valve means 20 is not present within the well casing 10. In this embodiment the choke plug 58 is depicted as a solid sphere of material. It is possible, however, to use choke plugs having other shapes.

As depicted in FIG. 5, the diameter of the spherically shaped choke plug 58 is smaller than the diameter of axial passageway 44. Choke plug 58 thereby blocks most of the cross-sectional area of axial passageway 44 so that the fluids can only pass through the restricted flow area 62 depicted schematically in FIG. 5. This configuration prevents the fluid from quickly flowing through passageway 44 in receptacle 40. After the choke plug 58 has been pumped down into well casing 10 and has lodged into position against plug stops 60, check valve means 20 may be pumped down into well casing 10 and latched into engagement with receptacle means 22 as previously described.

This embodiment of the apparatus may be used to regulate the flow of cement slurry through the casing and into the annulus. Before the choke plug 58 shown in FIG. 4 is pumped into place within receptacle 40, receptacle 40 is open and provides little obstruction to the flow of circulating fluid. After choke plug 58 is pumped into place within receptacle 40, choke plug 58 regulates the flow of cement slurry by forcing it to pass through the restricted flow area 62 shown in FIG. 5. This restriction prevents the cement slurry from flowing too quickly through receptacle passageway 44. After the cement slurry has been fully displaced from the casing into the annulus, check valve means 20 is pumped into locking engagement with receptacle means 22 to prevent the back flow of cement slurry into the casing.

Figure 6:
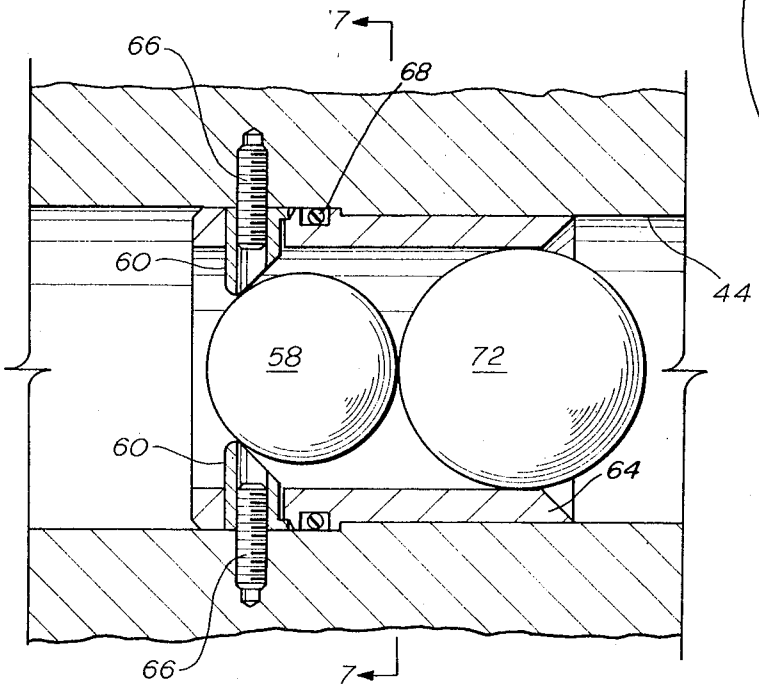
FIG. 6 is a sectional side view of a choke plug and pump out plug within a nozzle mounted within the axial passageway of the receptacle means.

In those instances in which the need for restricted fluid flow through choke plug 58 is followed by the need for free fluid flow, means may be provided for clearing the choke plug 58 from axial passageway 44 before the check valve means 20 is engaged within receptacle means 22. An apparatus for clearing choke plug 58 from axial passageway 44 is depicted in FIG. 6. During the construction of receptacle 40 a cylindrically shaped nozzle 64 is placed within axial passageway 44 of receptacle 40. Nozzle 64 possesses an external diameter that is only slightly smaller than the internal diameter of passageway 40 so that nozzle 64 is slidably disposed within passageway 44 of receptacle 40 at a very close tolerance. Nozzle 64 is fixed to receptacle 40 by a release mechanism such as a plurality of shear screws 66. The shear screws 66 may be inserted through the plug stops 60 as depicted in FIG. 6. An O-ring 68, in the external surface of nozzle 64 prevents the leakage of fluid through the interface between nozzle 64 and receptacle 40.

Figure 7:
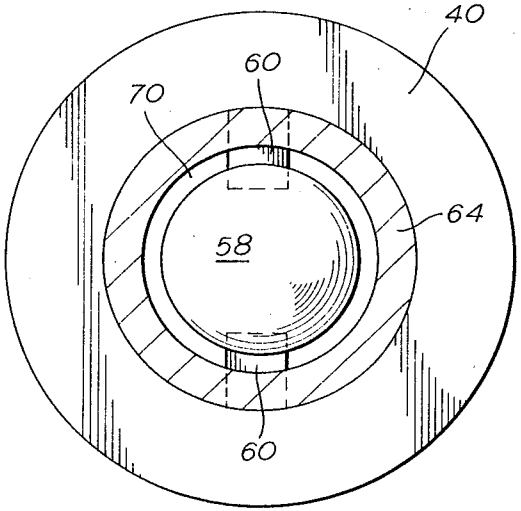
FIG. 7 is a cross-sectional view taken along line 7—7 of FIG. 6 showing the placement of the choke plug within the nozzle mounted within the axial passageway of the receptacle means.

In operation, choke plug 58 is pumped down into well casing 10 and lodges into position inside nozzle 64 against plug stops 60. As depicted in FIG. 7, the diameter of the spherically shaped choke plug 58 is smaller than the inner diameter of nozzle 64. Choke plug 58 thereby blocks most of the cross-sectional area of nozzle 64 so that the fluids can only pass through the restricted flow area 70 depicted schematically in FIG. 7. As before, this configuration prevents the fluid from quickly flowing through nozzle 64. After the need for restricted fluid flow has passed, a spherically shaped pump out plug 72 is pumped down into well casing 10 and lodges into position in nozzle 64 against choke plug 58. As shown in FIG. 6, the external diameter of pump out plug 72 is only slightly smaller than the inner diameter of nozzle 64. After pump out plug 72 has lodged within nozzle 64, nozzle 64 is completely sealed with respect to fluid flow. As the hydrostatic pressure in passageway 44 is increased, a hydrostatic force is applied against nozzle 64 and pump out plug 72. When the hydrostatic force reaches a sufficient level, the shear screws 66 break and release the obstruction of nozzle 64, choke plug 58 and pump out plug 72. After nozzle 64 and choke plug 58 and pump out plug 72 have been released and no longer obstruct passageway 44 of receptacle 40, check valve means 20 may be pumped down into well casing 10 and latched into engagement with receptacle means 22 as previously described.

Figure 8:
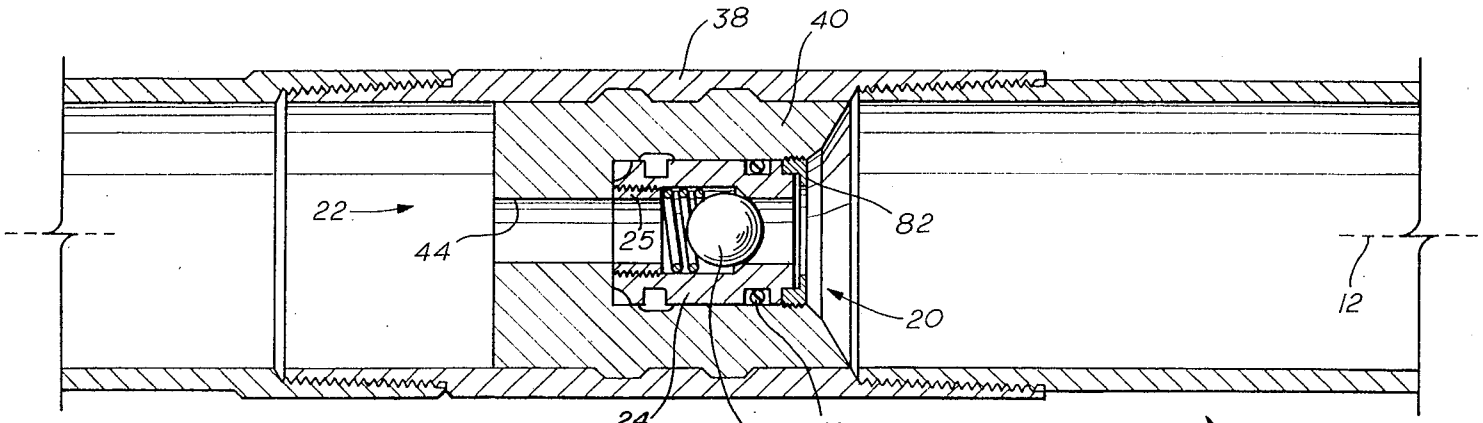
FIG. 8 is a sectional side view showing an alternate embodiment of the invention in which the check valve means is mounted within the receptacle means before the well casing is placed into the well.
Figure 8C:
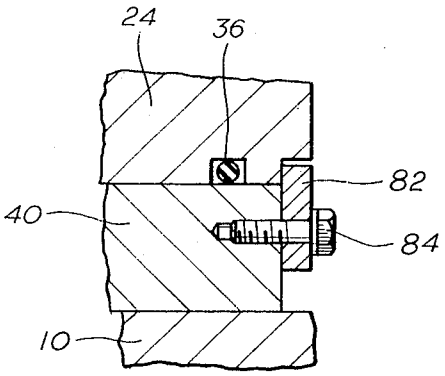
FIG. 8C is a sectional side view showing a retaining ring and retaining bolts for mounting the check valve means within the receptacle means.
Figure 8B:
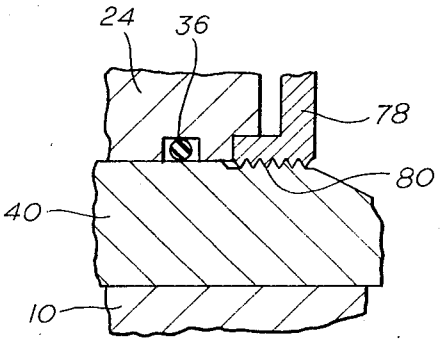
FIG. 8B is a sectional side view showing a threaded cap for mounting the check valve means within the receptacle means.
Figure 8A:
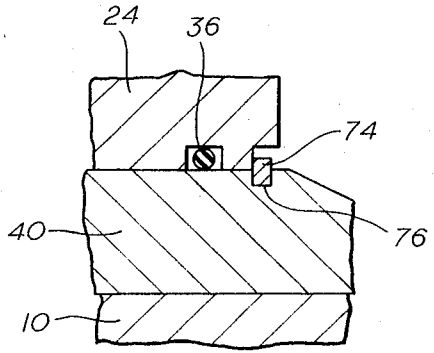
FIG. 8A is a sectional side view showing a snap ring and groove assembly for mounting the check valve means within the receptacle means.
Figure 9:
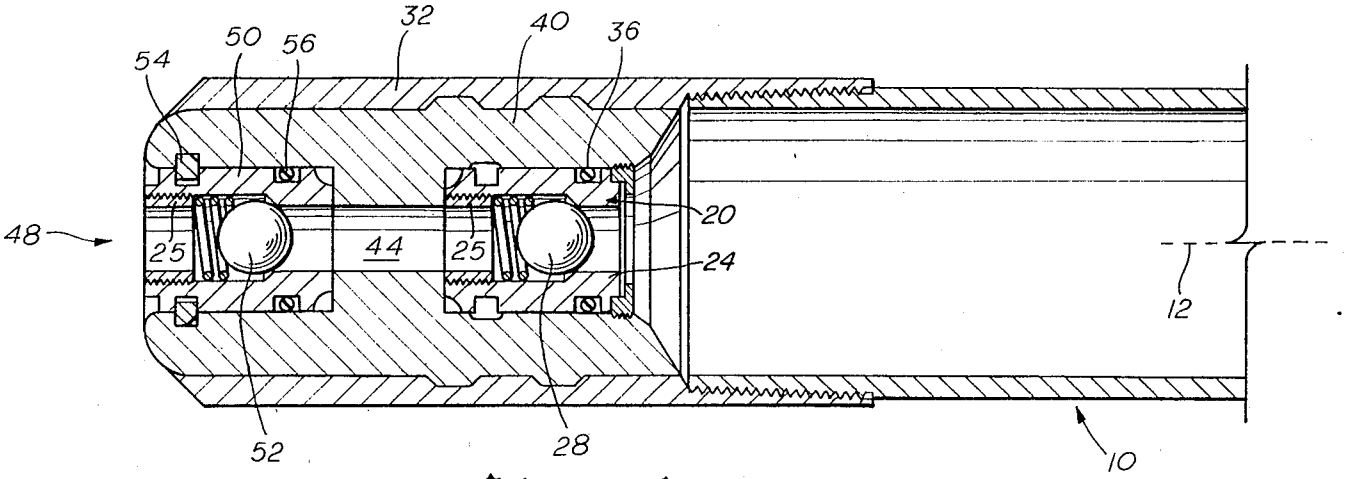
FIG. 9 is a sectional side view showing an alternate embodiment of the invention in which the check valve means is mounted within the receptacle means in a float shoe before the well casing is placed into the well.

As shown in FIG. 8, the check valve means 20 may be releasably secured within the receptacle means 22 before the well casing 10 is placed into the well. In this embodiment of the invention the latching means 34 is removed from check valve housing 24. Then after the check valve housing 24 has been fully inserted into receptacle 40 with O-ring 36 sealing between housing 24 and receptacle 40, check valve housing 24 may be secured within receptacle 40 by any of a number of well known methods. Three such methods are depicted in FIG. 8A, FIG. 8B and FIG. 8C. The body of the check valve housing 24 may be retained within receptacle 40 via a snap ring 74 engaging groove 76 of receptacle 40 as shown in FIG. 8A. The body of the check valve housing 24 may be retained within receptacle 40 via a threaded cap 78 adapted to be threaded into a threaded portion 80 of receptacle 40 as shown in FIG. 8B. The body of the check valve housing 24 may be retained within receptacle 40 via a retaining ring 82 bolted into receptacle 40 via retaining bolts 84 as shown in FIG. 8C. Other means of retaining check valve housing 24 within receptacle 40 may be devised. As shown in FIG. 9, the check valve housing 24 may also be similarly mounted in a float shoe before the well casing 10 is placed into the well. In this embodiment of the invention the check valve means 20 may be removed from receptacle 40 after the well casing 10 has been removed from the well.

Figure 10:
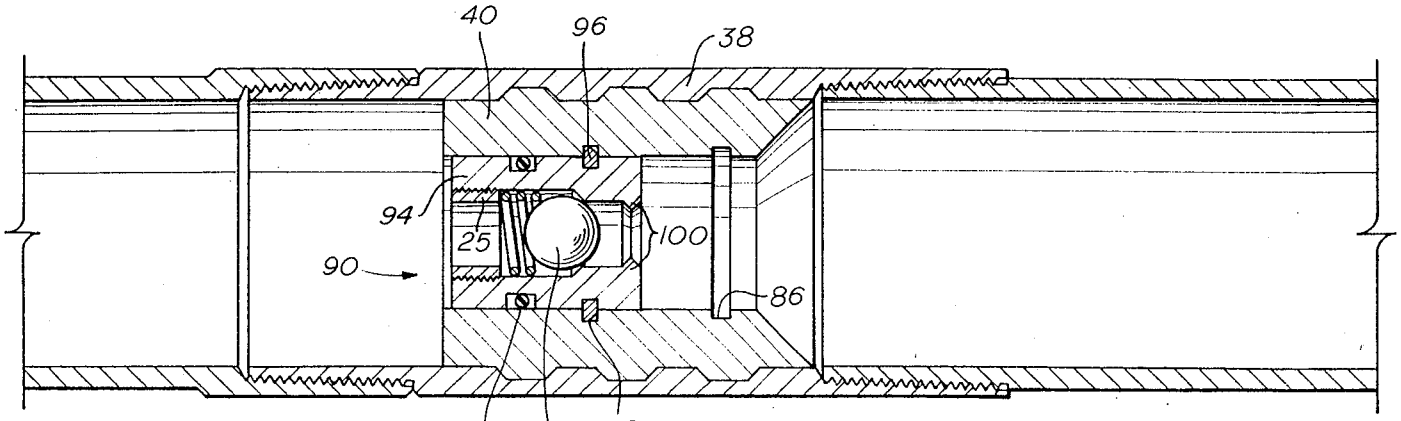
FIG. 10 is a sectional side view of an alternate embodiment of the invention showing an alternate form of the receptacle means and a check valve means releasably mounted within it.
Figure 11:
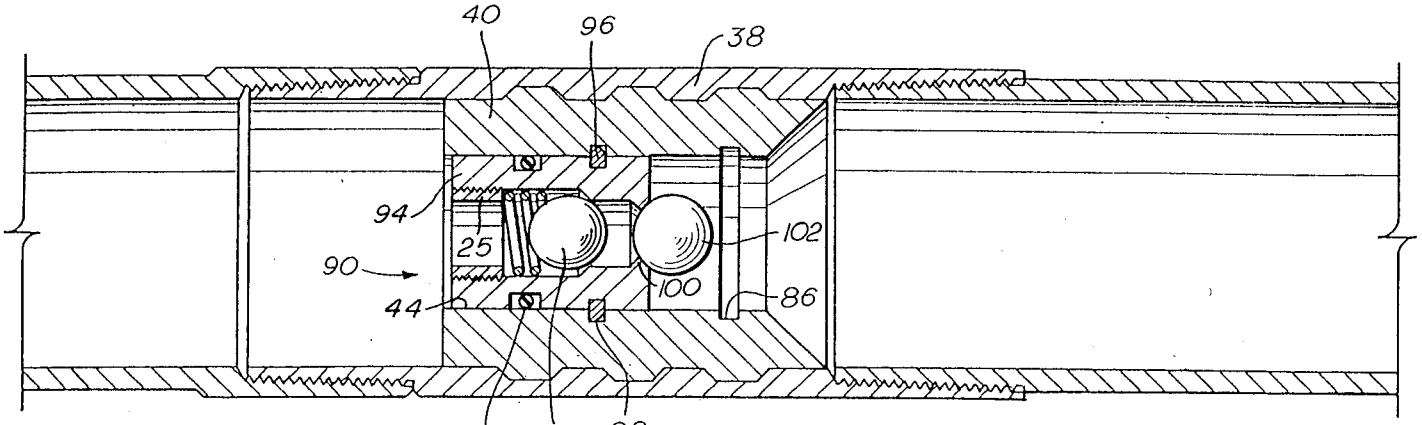
FIG. 11 is a sectional side view of an alternate embodiment of the invention showing a pump out plug resting on the top of a check valve means releasably mounted within the alternate form of the receptacle means.
Figure 12:
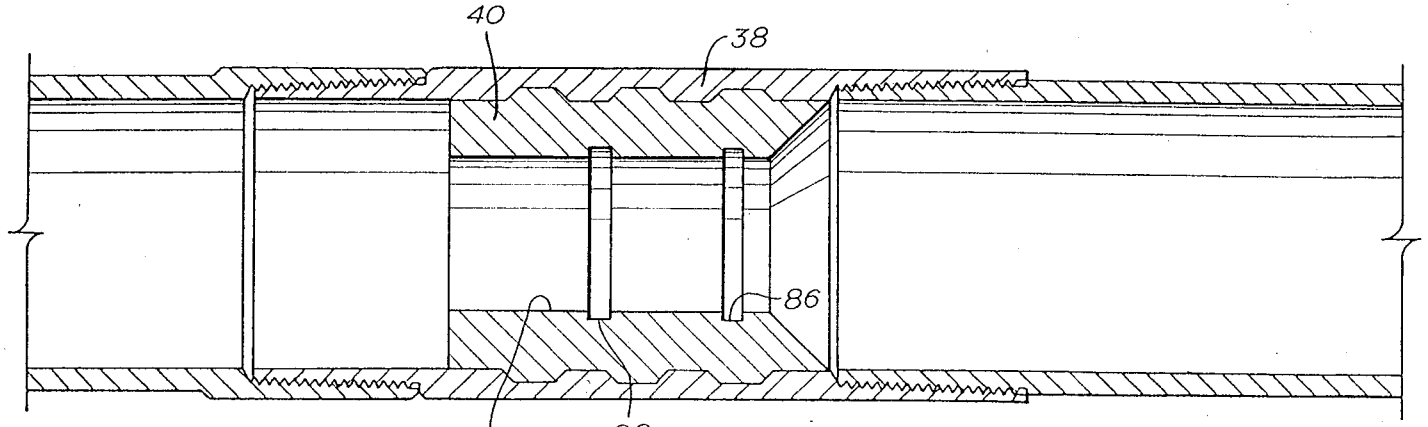
FIG. 12 is a sectional side view of the alternate form of the receptacle means.

An alternate form of the invention is depicted in FIG. 10 through FIG. 14. In this embodiment of the invention receptacle 40 as shown in FIG. 12 is formed having two grooves, 86 and 88, cut within the inner cylindrical surface of receptacle 40 that defines the walls of receptacle passageway 44. Although the use of a receptacle 40 having two grooves, 86 and 88, will be described, it may be readily seen that a single groove may be used equally well in practicing this form of the invention.

The receptacle housing 38 containing receptacle 40 may be run in the casing string with receptacle 40 in two different modes of operation. Receptacle 40 may be fully open as shown in FIG. 12 or receptacle 40 may contain a check valve means 90 mounted within groove 88 as shown in FIG. 10.

The check valve means 90 is constructed in a manner similar to that previously described. It comprises a check valve 92, a check valve housing 94, a frangible latching means 96 and an O-ring 98. Latching means 96 engages groove 88 and holds the check valve means 90 in place within receptacle 40. In this embodiment of the invention the walls of check valve housing 94 are formed having a cylindrically symmetrical inwardly extending lip 100 as shown in FIG. 10 and FIG. 11. The lip 100 is formed to receive and seat a pump out plug 102. Although the pump out plug 102 has been shown as a sphere and the lip 100 has been shown in a form adapted to receive a spherical pump out plug, it is clear that other pump out plugs and lips having a different geometry could be designed.

In operation, check valve means 90 is in place within receptacle 40 locked in groove 88 when receptacle housing 38 is run into the well bore. The check valve means 90 in the receptacle 40 is closed against the fluids in the well bore and prevents the entry of the fluid into the casing while the casing string is being run. After the casing string has been run into the well bore and has reached total depth (i.e., the bottom of the well bore), the casing would normally be filled with circulating fluid. Because the presence of check valve means 90 would impede the flow of the circulating fluid out of the casing into the annulus, the check valve means 90 is removed from receptacle 40 before the circulating fluid is admitted into the casing. This is accomplished by dropping pump out plug 102 into the casing and letting it descend to and seat upon lip 100 of the check valve housing thereby sealing off fluid flow through check valve 92. The hydrostatic pressure in the casing is then increased until the frangible latching means 96 break and release housing 94 with check valve means 90 from the receptacle passageway 44. The circulating fluid may then be pumped through the receptacle passageway 44 with relatively little obstruction.

In the next phase of operations the cement slurry is run. Due to its specific gravity the cement slurry would fall rapidly through the relatively open aperture of receptacle passageway 44. In order to control the rate of cement slurry flow through the casing string and prevent the cement slurry from flowing too quickly, the invention utilizes a choke valve means 104 shown in FIGS. 13 and 14.

Figure 13:
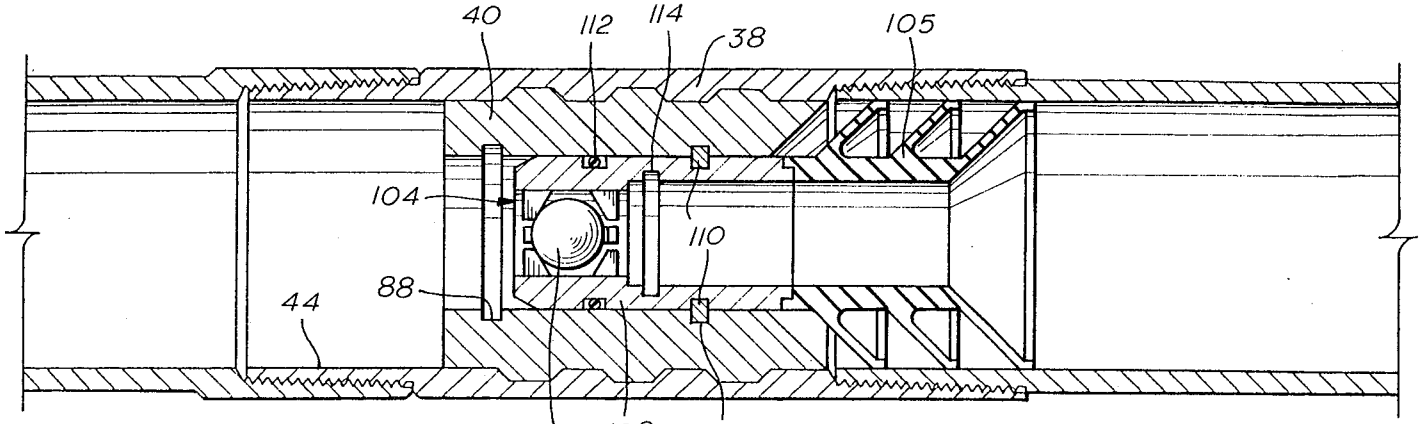
FIG. 13 is a sectional side view of an alternate embodiment of the invention showing the alternate form of the receptacle means containing a choke valve means.

Choke valve means 104 comprises a choke valve 106, a choke valve housing 108, a latching means 110 for engagement with groove 86, and an O-ring 112. For reasons to be explained below, a groove 114 is cut within the inner cylindrical surface of the walls of choke valve housing 108. The choke valve means 104 is pumped down the casing string into locking engagement with groove 86 of receptacle 40. As shown in FIG. 13, cylindrically shaped guide means 105 are attached to the choke valve means 104 to center and align the choke valve means 104 with respect to receptacle 40. Once it is in place, check valve 106 regulates the flow of the cement slurry out of the casing as the cement is being displaced into the annulus between the external surface of the casing and the well bore.

Figure 14:
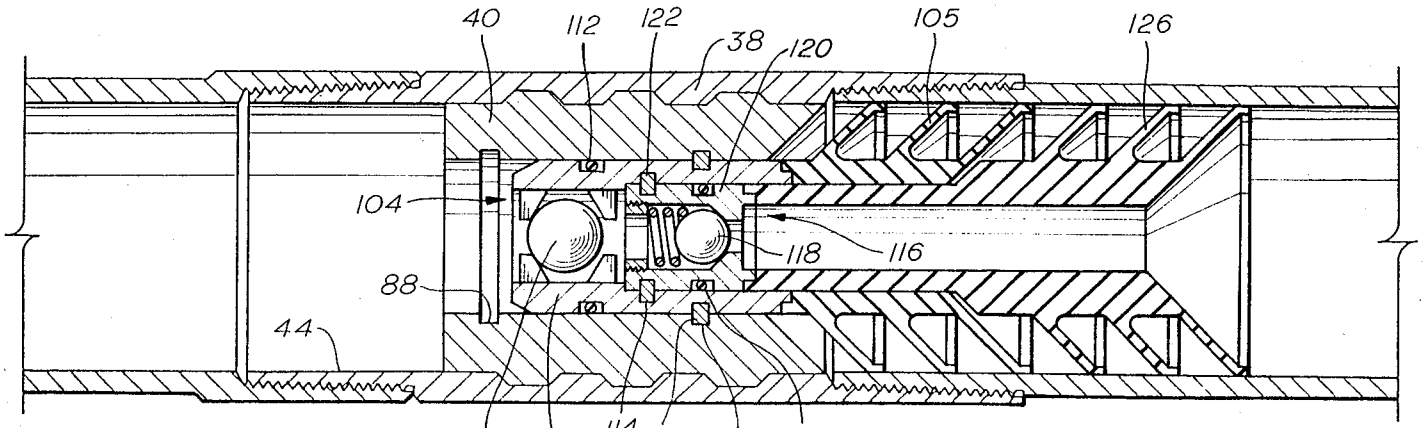
FIG. 14 is a sectional side view of an alternate embodiment of the invention showing the alternate form of the receptacle means containing a choke valve means and a back pressure check valve.

After the cement has been displaced from the casing, it is necessary to prevent the back flow of cement slurry into the casing until the cement slurry sets and hardens. To prevent the back flow of cement slurry, the invention utilizes an additional check valve means 116 shown in FIG. 14. Check valve means 116 comprises a check valve 118, a check valve housing 120, a latching means 122 for engagement with groove 114, and an O-ring 124. The check valve means 116 is constructed having such dimensions that it will fit inside the choke valve means 104 as shown in FIG. 14. The check valve means 116 is pumped down the casing string into locking engagement with the groove 114 in choke valve housing 108. Cylindrically shaped guide means 126 are attached to the check valve means 116 to center and align the check valve means 116 with respect to the choke valve means 104. Once it is in place, check valve means 116 keeps the cement slurry from reentering the interior of the casing.

After the cement slurry has set and hardened, then drilling operations may be resumed. Receptacle 40, choke valve means 104 and check valve means 116 are all constructed of frangible material so that they may be drilled through and broken up by the drill string.

In an alternate embodiment of the invention, choke valve 106 may be mounted within choke valve housing 108 with a release mechanism such as a plurality of frangible shear screws (not shown) similar to FIG. 6. Choke valve 106 may be removed from choke valve housing 108 with a spherically shaped pump out plug (not shown) as previously described for the embodiment of FIG. 6. After the pump out plug has sealed choke valve 106 with respect to fluid flow, the hydrostatic pressure in the well casing may be increased until the frangible shear screws holding choke valve 106 break thereby releasing choke valve 106 from choke valve housing 108. With this embodiment of the invention, it is possible to remove choke valve 106 from choke valve housing 108 before check valve means 116 is pumped down the casing string into locking engagement with groove 114 and choke valve housing 108.

It is evident from the foregoing that an improved apparatus and method has been described for inserting and removing flow control means in a well casing in conjunction with cementing operations and that the improved apparatus and method overcome disadvantages found in prior art systems.

While the invention has been particularly shown and described with reference to preferred and alternative embodiments thereof, it will be understood by those skilled in the art that various changes in size, shape, symmetry, materials and in the details of this illustrated apparatus and method may be made within the scope of the appended claims without departing from the spirit of the invention.

We claim:

1. An apparatus for inserting flow control means into a well casing in a well during cementing operations comprising:

check valve means;

choke valve means adapted to receive said check valve means when said check valve means is inserted into said choke valve means; and receptacle means mounted within said well casing, said receptacle means adapted to receive said choke valve means when said choke valve means is inserted into said well casing after said well casing has been placed into said well.

2. An apparatus for inserting flow control means into a well casing in a well during cementing operations comprising:

a choke valve housing having portions forming a first passageway through said housing;

a choke valve secured within said first passageway of said choke valve housing;

a receptacle housing mounted within said well casing;

a receptacle mounted within said receptacle housing, said receptacle having portions forming a second passageway through said receptacle, said receptacle adapted to receive said choke valve housing within said second passageway when said choke valve housing is inserted into said well casing after said well casing has been placed into said well;

a check valve housing adapted to fit within said first passageway of said choke valve housing when said choke valve housing is inserted into said receptacle in said well casing after said well casing has been placed into said well; and a check valve secured within said check valve housing.

3. A method for inserting flow control means into a well casing during cementing operations comprising the steps of:

releasably securing a check valve into a check valve housing, said check valve housing having portions forming a first passageway through said check valve housing into which said check valve may be releasably secured;

mounting a receptacle within a receptacle housing, said receptacle having portions forming a second passageway through said receptacle, said receptacle adapted to receive said check valve housing within said second passageway;

mounting said receptacle housing containing said receptacle within said well casing;

inserting said check valve housing containing said check valve into said receptacle; and placing said well casing containing said receptacle housing, said receptacle, said check valve housing and said check valve into a well.

4. A method for inserting flow control means in a well casing in a well during cementing operations comprising the steps of:

releasably securing a check valve into a check valve housing, said check valve housing having portions forming a first passageway through said check valve housing into which said check valve may be releasably secured;

mounting a receptacle within a receptacle housing, said receptacle having portions forming a second passageway through said receptacle, said receptacle adapted to receive said check valve housing within the upper end of said second passageway and to receive a choke plug within the lower end of said second passageway;

mounting said receptacle housing containing said receptacle within said well casing;

placing said well casing containing said receptacle housing and said receptacle into a well;

passing a circulating fluid down through the well casing and through said second passageway of said receptacle and through the lower end of the well casing and upwardly through the annular space between the external surface of the well casing and the wellbore of the well;

inserting a choke plug into said receptacle to block a portion of the cross sectional area of fluid flow through said second passageway of said receptacle;

passing a cement slurry down through the well casing and through said second passageway of said receptacle and past said choke plug and through the lower end of the well casing and upwardly through the annular space between the external surface of the well casing and the wellbore of the well; and inserting said check valve housing containing said check valve into said receptacle to prevent the back flow of cement slurry in the annulus.

5. A method for inserting flow control means in a well casing in a well comprising the steps of:

releasably securing a check valve into a check valve housing, said check valve housing having portions forming a first passageway through said check valve housing into which said check valve may be releasably secured;

mounting a receptacle within a receptacle housing, said receptacle having portions forming a second passageway through said receptacle, said receptacle adapted to receive said check valve housing within the upper end of said second passageway and to receive a choke plug within a nozzle mounted with frangible shear screws in the lower end of said second passageway;

mounting said receptacle housing containing said receptacle within said well casing;

placing said well casing containing said receptacle housing and said receptacle into a well;

passing a first fluid down through the well casing and through said second passageway of said receptacle and through the lower end of the well casing and upwardly through the annular space between the external surface of the well casing and the wellbore of the well;

inserting a choke plug into said nozzle mounted within said receptacle to block a portion of the cross sectional area of fluid flow through said second passageway of said receptacle;

passing a second fluid down through the well casing and through said second passageway of said receptacle and past said choke plug and through the lower end of the well casing and upwardly through the annular space between the external surface of the well casing and the wellbore of the well;

inserting a pump out plug into said nozzle mounted within said receptacle to seal said nozzle with respect to fluid flow;

increasing the hydrostatic pressure in the well casing until the frangible shear screws holding the nozzle break and thereby release said nozzle, said choke plug and said pump out plug from said second passageway of said receptacle; and inserting said check valve housing containing said check valve into said receptacle.

6. A method for inserting flow control means in a well casing in a well during cementing operations comprising the steps of:

securing a choke valve into a choke valve housing, said choke valve housing having portions forming a first passageway through said choke valve housing into which said choke valve may be secured;

mounting a receptacle within a receptacle housing, said receptacle having portions forming a second passageway through said receptacle, said receptacle adapted to receive said choke valve housing within said second passageway;

mounting said receptacle housing containing said receptacle within said well casing;

placing said well casing containing said receptacle housing and said receptacle into a well;

passing a circulating fluid down through the well casing and through said second passageway of said receptacle and through the lower end of the well casing and upwardly through the annular space between the external surface of the well casing and the wellbore of the well;

inserting said choke valve housing containing said choke valve into said receptacle to block a portion of the cross sectional area of fluid flow through said second passageway of said receptacle;

passing a cement slurry down through the well casing and through said second passageway of said receptacle and past said choke valve and through the lower end of the well casing and upwardly through the annular space between the external surface of the well casing and the wellbore of the well.

7. A method for inserting flow control means in a well casing in a well during cementing operations comprising the steps of:

securing a choke valve into a choke valve housing, said choke valve housing having portions forming a first passageway through said choke valve housing into which said choke valve may be secured;

securing a check valve into a check valve housing, said check valve housing adapted to fit within said first passageway of said choke valve housing;

mounting a receptacle within a receptacle housing, said receptacle having portions forming a second passageway through said receptacle, said receptacle adapted to receive said choke valve housing within said second passageway;

mounting said receptacle housing containing said receptacle within said well casing;

placing said well casing containing said receptacle housing and said receptacle into a well;

passing a circulating fluid down through the well casing and through said second passageway of said receptacle and through the lower end of the well casing and upwardly through the annular space between the external surface of the well casing and the wellbore of the well;

inserting said choke valve housing containing said choke valve into said receptacle to block a portion of the cross sectional area of fluid flow through said second passageway of said receptacle;

passing a cement slurry down through the well casing and through said second passageway of said receptacle and past said choke valve and through the lower end of the well casing and upwardly through the annular space between the external surface of the well casing and the wellbore of the well; and inserting said check valve housing containing said check valve into said first passageway of said choke valve housing within said receptacle to prevent the back flow of cement slurry into the annulus.

8. A method for inserting flow control means in a well casing comprising the steps of:

securing a choke valve into a choke valve housing, said choke valve housing having portions forming a first passageway through said choke valve housing into which said choke valve may be secured;

securing a first check valve into a first check valve housing, said first check valve housing adapted to fit within said first passageway of said choke valve housing;

mounting a receptacle within a receptacle housing, said receptacle having portions forming a second passageway through said receptacle, said receptacle adapted to receive said choke valve housing within said second passageway and adapted to receive a second check valve housing within said second passageway;

securing a second check valve into a second check valve housing, said second check valve housing adapted to fit within said second passageway of said receptacle;

mounting said second check valve housing containing said second check valve within said second passageway of said receptacle with frangible latching means;

mounting said receptacle housing containing said receptacle containing said second check valve housing and said second check valve within said well casing;

placing said well casing containing said receptacle housing and said receptacle into a well;

inserting a pump out plug into said second passageway of said receptacle to seal said second check valve housing with respect to fluid flow;

increasing the hydrostatic pressure in the well casing until the frangible latching means holding said second check valve housing break and thereby release said second check valve housing and said second check valve from said second passageway of said receptacle;

passing a circulating fluid down through the well casing and through said second passageway of said receptacle and through the lower end of the well casing and upwardly through the annular space between the external surface of the well casing and the wellbore of the well;

inserting said choke valve housing containing said choke valve into said receptacle to block a portion of the cross sectional area of fluid flow through said second passageway of said receptacle;

passing a cement slurry down through the well casing and through said second passageway of said receptacle and past said choke valve and through the lower end of the well casing and upwardly through the annular space between the external surface of the well casing and the wellbore of the well; and inserting said first check valve housing containing said first check valve into said first passageway of said choke valve housing within said receptacle to prevent the back flow of cement slurry into the annulus.

9. A method for inserting flow control means in a well casing comprising the steps of:

securing a choke valve into a choke valve housing with a frangible release mechanism, said choke valve housing having portions forming a first passageway through said choke valve housing into which said choke valve may be secured;

securing a first check valve into a first check valve housing, said first check valve housing adapted to fit within said first passageway of said choke valve housing;

mounting a receptacle within a receptacle housing, said receptacle having portions forming a second passageway through said receptacle, said receptacle adapted to receive said choke valve housing within said second passageway and adapted to receive a second check valve housing within said second passageway;

securing a second check valve into a second check valve housing, said second check valve housing adapted to fit within said second passageway of said receptacle;

mounting said second check valve housing containing said second check valve within said second passageway of said receptacle with frangible latching means;

mounting said receptacle housing containing said receptacle containing said second check valve housing and said second check valve within said well casing;

placing said well casing containing said receptacle housing and said receptacle into a well;

inserting a pump out plug into said second passageway of said receptacle to seal said second check valve housing with respect to fluid flow;

increasing the hydrostatic pressure in the well casing until the frangible latching means holding said second check valve housing break and thereby release said second check valve housing and said second check valve from said second passageway of said receptacle;

inserting said choke valve housing containing said choke valve into said receptacle to block a portion of the cross sectional area of fluid flow through said second passageway of said receptacle;

passing a circulating fluid down through the well casing and through said second passageway of said receptacle and past said choke valve and through the lower end of the well casing and upwardly through the annular space between the external surface of the well casing and the wellbore of the well;

inserting a pump out plug into said choke valve housing to seal said choke valve with respect to fluid flow;

increasing the hydrostatic pressure in the well casing until the frangible release mechanism holding said choke valve breaks and thereby releases said choke valve from said choke valve housing; and inserting said first check valve housing containing said first check valve into said first passageway of said choke valve housing within said receptacle.

10. An apparatus for inserting flow control means into a well casing in a well during cementing operations comprising:

check valve means adapted to be positioned within said casing to permit fluid flow down the well and to block fluid flow up the well;

choke valve means adapted to be positioned within said casing below said check valve means to restrict fluid flow; and receptacle means mounted within said well casing, said receptacle means adapted to receive said choke valve means and said check valve means.

11. An apparatus for inserting flow control means into a well casing in a well during cementing operations comprising:

first check valve means adapted to be positioned within said casing to permit fluid flow down the well and to block fluid flow up the well;

receptacle means mounted within said well casing and receiving said first check valve means therein; and second check valve means adapted to be positioned within said casing above said first valve means after insertion of said receptacle means and said first check valve means within the casing, said receptacle means adapted to receive said second check valve means when said second valve means is inserted into said well casing after said well casing has been placed into said well.

12. An apparatus for inserting flow control means into a well casing in a well during cementing operations comprising:

receptacle means mounted within the casing and having a fluid passageway extending axially therethrough, a plurality of valve support stops projecting from said receptacle means within said fluid passageway and spaced radially about the passageway;

a choke valve of a diameter less than the diameter of said passageway adapted to be positioned within said casing after the mounting of said receptacle means and to be supported on said valve support stops while permitting a restricted fluid flow along said passageway; and check valve means positioned within said receptacle means above said choke valve.

13. An apparatus for inserting flow control means into a well casing as set forth in claim 12 wherein said valve support stops are frangible and shear upon the application of a predetermined force on said choke valve thereby to release said choke valve.

14. An apparatus for inserting flow control means into a well casing in a well during cementing operations comprising:

a choke valve housing having portions forming a first passageway through said housing;

a choke valve secured within said first passageway of said choke valve housing to restrict fluid flow through said first passageway;

a receptacle housing mounted within said well casing;

a receptacle mounted within said receptacle housing, said receptacle having portions forming a second passageway through said receptacle, said receptacle adapted to receive said choke valve housing within said second passageway when said choke valve housing is inserted into said well casing after said well casing has been placed into said well;

latching means mounted on said choke valve housing for latching said choke valve housing into engagement with said receptacle upon insertion thereof; and check valve means mounted within said receptacle within said second passageway above said choke valve.

15. An apparatus for inserting flow control means into a well casing in a well during cementing operations comprising:

receptacle means mounted within said well casing and having a fluid passageway extending axially therethrough, said receptacle means having upper and lower end portions;

said lower end portion receiving first valve means therein positioned within said fluid passageway with said first valve means positioned within said receptacle means upon mounting of said receptacle means within said casing; and second valve means including a check valve adapted to be selectively latched within said upper end portion after the mounting of said receptacle means and first valve means within said casing.

16. An apparatus for inserting flow control means into a well casing as set forth in claim 15 wherein said first valve means comprises a check valve.

17. An apparatus for inserting flow control means into a well casing as set forth in claim 15 wherein said first valve means comprises a choke valve.

18. A method for inserting flow control means in a well casing in a well during cementing operations comprising the steps of:

mounting a receptacle with a fluid passageway therethrough within a receptacle housing, said receptacle adapted to receive a check valve within the upper end of said fluid passageway and to receive a choke plug within the lower end of said fluid passageway;

mounting said receptacle housing containing said receptacle within said well casing;

placing said well casing containing said receptacle housing and said receptacle into a well;

passaging a circulating fluid down through the well casing and through said fluid passageway of said receptacle and through the lower end of the well casing and upwardly through the annular space between the external surface of the well casing and the wellbore of the well;

inserting a choke plug into said receptacle to block a portion of the cross sectional area of fluid flow through said fluid passageway of said receptacle;

passing a cement slurry down through the well casing and through said fluid passageway of said receptacle and past said choke plug and through the lower end of the well casing and upwardly through the annular space between the external surface of the well casing and the wellbore of the well; and inserting a check valve into said receptacle to prevent the back flow of cement slurry in the annulus.

* * * * *